US006814654B2

(12) United States Patent
Rolfi

(10) Patent No.: US 6,814,654 B2
(45) Date of Patent: Nov. 9, 2004

(54) MACHINE FOR DRYING, POLISHING AND BURNISHING CUTLERY AND METAL TABLEWARE

(75) Inventor: Emilio Rolfi, Torbole Casaglia (IT)

(73) Assignee: Hyppocampus S.r.l., Torbole Casaglia Brescia (IT)

( * ) Notice: Subject to any disclaimer, the term of this patent is extended or adjusted under 35 U.S.C. 154(b) by 20 days.

(21) Appl. No.: 10/268,453

(22) Filed: Oct. 10, 2002

(65) Prior Publication Data

US 2003/0077992 A1 Apr. 24, 2003

(30) Foreign Application Priority Data

Oct. 18, 2001 (IT) ..... BS20010084 U

(51) Int. Cl.[7] ..... B24B 31/00

(52) U.S. Cl. ..... 451/326; 451/104; 451/372; 451/113

(58) Field of Search ..... 451/104, 113, 451/327, 326, 117

(56) References Cited

U.S. PATENT DOCUMENTS

| | | | | | |
|---|---|---|---|---|---|
| 5,117,850 | A | * | 6/1992 | Money | 134/63 |
| 5,779,527 | A | * | 7/1998 | Maebashi | 451/328 |
| 6,110,020 | A | * | 8/2000 | Rolfi | 451/104 |
| 2001/0016224 | A1 | * | 8/2001 | Huttlin | 427/2.14 |

* cited by examiner

*Primary Examiner*—Lee D. Wilson
(74) *Attorney, Agent, or Firm*—McGlew and Tuttle, P.C.

(57) ABSTRACT

This invention concerns a machine for the drying, polishing and burnishing cutlery and other metal tableware. It consists of a tank suspended upon a base and moved by a vibrating device, having a treatment channel (15) designed to receive a drying material and the articles for treatment. The treatment channel (15) rises in a spiral from an entrance chute at the loading mouth to an exit passage or chute for the articles and has, in a transverse cross-section, a U-shaped bottom (22) defined by a substantially cylindrical concave surface and, lengthways, by a series of straight segments (23) which alternate with and are joined to curved segments (24), without sharp edges or corners. Ideally, the channel has a steeper gradient towards the exit.

5 Claims, 3 Drawing Sheets

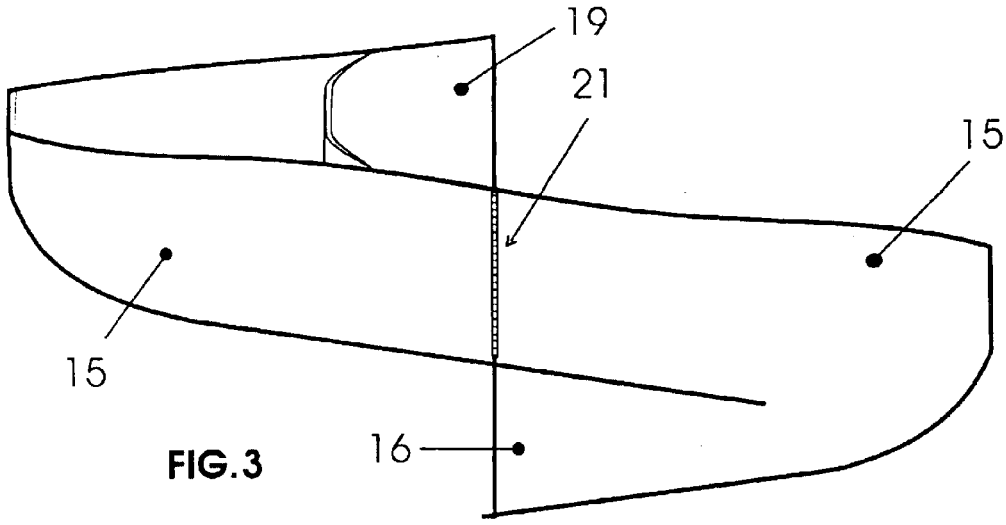
FIG.3
FIG.2
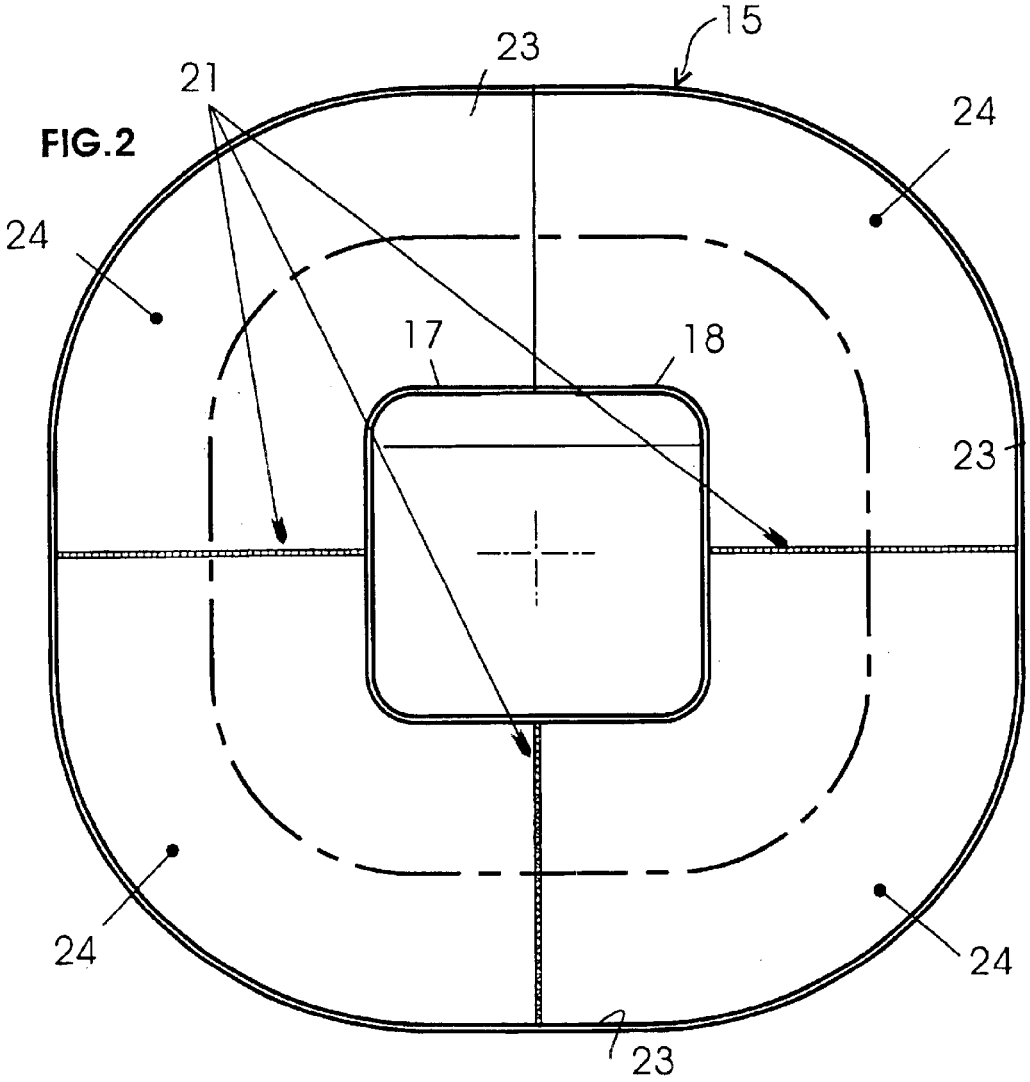

MACHINE FOR DRYING, POLISHING AND BURNISHING CUTLERY AND METAL TABLEWARE

FIELD OF THE INVENTION

This invention concerns machines for drying, polishing and burnishing cutlery and other metal tableware with the use of a treatment material, such as, for example, a granulation of corn shavings.

BACKGROUND OF THE INVENTION

In restaurants, canteens, communities and similar, the dirty cutlery, plates, glasses, etc. are cleaned in the dishwasher, then dried with the aid of a drying material and finally heated to completely remove water.

In a previous disclosure of the same applicant, corresponding to U.S. Pat. No. 6,110,020, there was a specific proposal for a machine that dries, polishes and burnishes cutlery and metal tableware, with the purpose of removing all traces of lime-scale, marks or stains from the surface and, thereby, polishing the metal.

Such a machine has a vibrating tank in which there is a channel through which the drying material and the objects to be treated have to pass. The tank with the channel is generally made by welding metal sheets together and covering this with a protective plastic lining. The channel spirals upwards, from an entrance chute at the level of a central mouth for the loading of objects, up to an exit chute on an outer rim of the tank. The drying material and the articles gradually progress up the spiral channel, thanks to the vibration applied to the tank. The channel is substantially quadrilateral in cross-section, with vertical side walls and a flat bottom. Seen in layout, it has a polygonal shape, with straight walls joined by corner pieces, which are also straight.

Said machine, however, is not completely free of drawbacks. In fact, on account of the shape of the treatment channel, the articles being treated come to rest on the flat bottom and have difficulty in advancing regularly up along the channel. These difficulties are added to by the fact that the articles tend to end up crosswise in the channel, becoming blocked against the side walls. This is even more likely in the corner areas at the end of each straight section, where the items have to change direction. This is at the detriment of the machine's functionality and efficiency, with the further disadvantage of making the machine very noisy, as the pieces bump against the channel walls.

OBJECT AND SUMMARY OF THE INVENTION

The present invention has been designed effectively to remove the drawbacks of the machine described above.

In fact, one of the objects of this invention is to make and supply a machine for drying, polishing and burnishing metal tableware with an improved shape, operation and inclination of the channel that the drying material and articles have to climb, improving the efficiency and reliability of the machine and the effectiveness of the treatment.

Said object and the advantages it involves is reached, in accordance with the present invention, with a machine for drying, polishing and burnishing cutlery and metal articles, in which the treatment channel, climbing in a spiral shape from an entrance chute to an exit chute, has, in a transverse cross-section, a U-shaped bottom defined by a surface that is substantially a concave cylinder, and, lengthways, has an alternating series of straight sections and curved joints.

Thus, the channel is freed of sharp bends and corners that may block the advance of the articles during the treatment phase. Thanks to the concave bottom, furthermore, the articles tend to remain and return to the lowest part of said bottom, at the centre of the channel, immersed in the drying material, without ever ending up crossways, bumping against the walls and becoming stuck, even when following the curves that mark a change in direction. Consequently, the machine is less noisy, even though it has no plastic protective lining along the channel surfaces.

Another benefit lies in the fact that the treatment channel has a variable inclination, with a steeper gradient towards the exit passage or chute. This means that the drying material and the articles advance more slowly, at least in the final part of the channel, in order to improve the effectiveness of the treatment and to favour the separation of the drying material from the articles when they reach a grill at the end.

BRIEF DESCRIPTION OF THE DRAWINGS

Further details of the invention will become evident from the description below, which is made with reference to the enclosed drawings, which are indicative but not binding, and in which:

FIG. 2 is a layout of the treatment channel;

FIG. 3 is a side view of the channel:

DETAIL DESCRIPTION OF THE INVENTION

Figure 1:
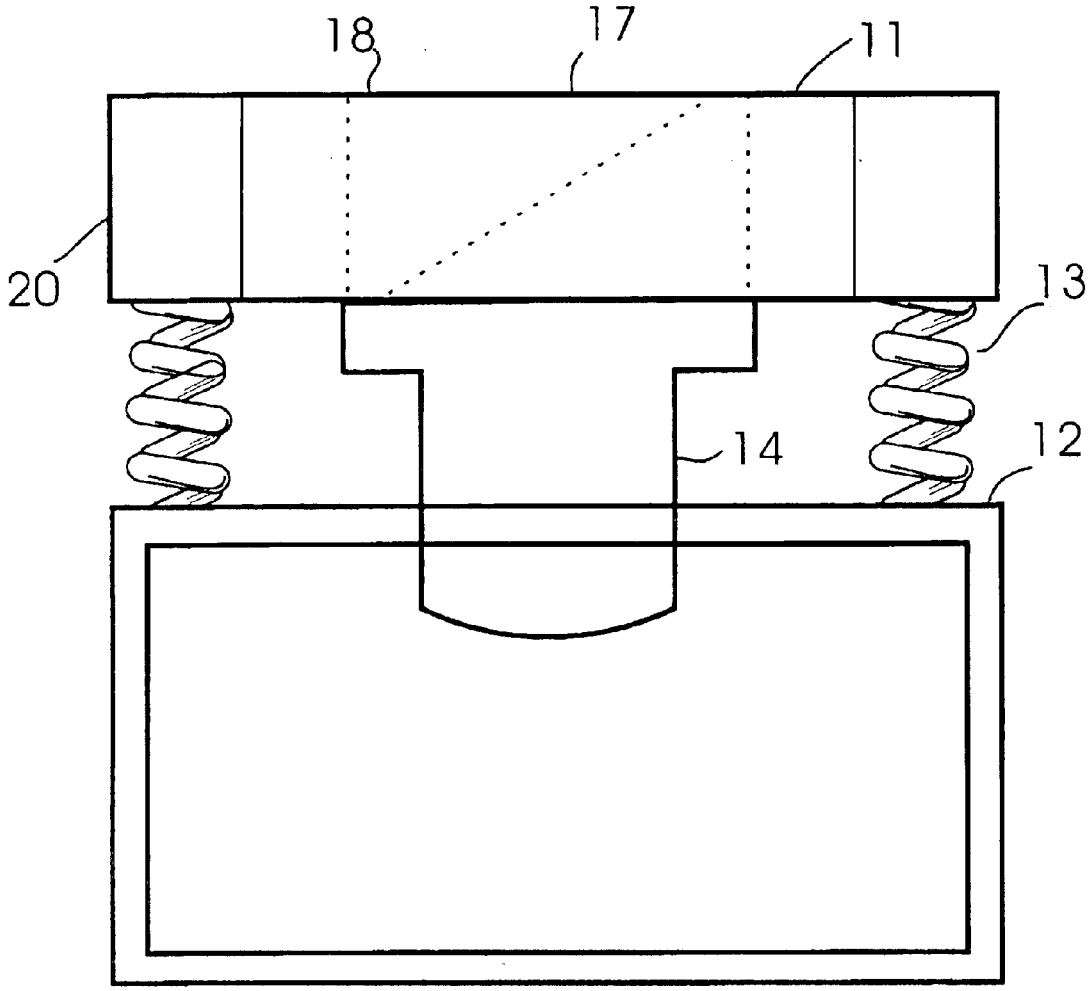
FIG. 1 is a view of the machine from the side.
Figure 4:
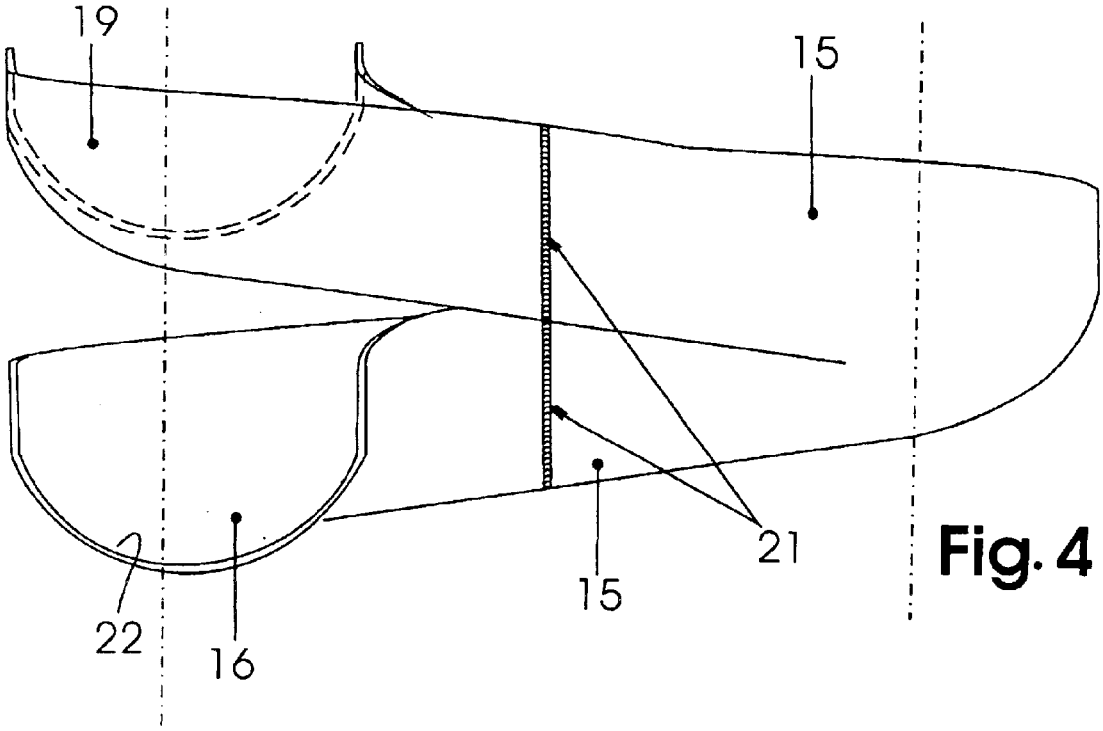
FIG. 4 is a cross-section of the channel.
Figure 5:
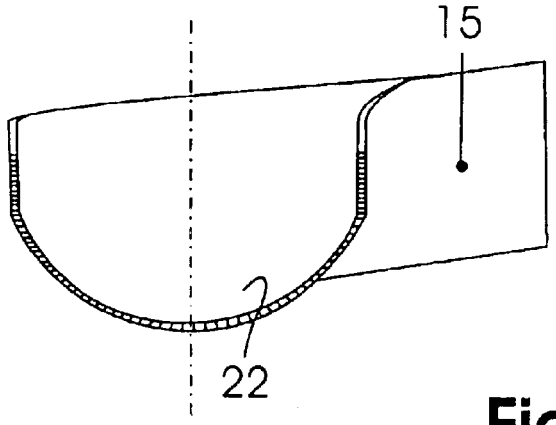
FIG. 5 is a transverse cross-section.

The machine of the invention consists essentially of a tank 11 suspended over a base 12 with springs 13 between them, associated with a motor-driven vibrator 14, which keeps the whole in vibration during operation.

The tank 11 contains a treatment channel 15, designed to receive the drying material as well as the articles for treating. The drying material may be a granulation of corn shavings, or another suitable product that also performs the polishing and burnishing.

The channel 15 has a spiral shape which rises from a lower part 16, where the articles for treatment are delivered by means of a chute 17, located in a central loading mouth 18, up to a higher part 19, where the articles are unloaded outside the tank, by means of an exit passage or chute 20, while the drying material is separated from the articles, falling through a grill, as already used elsewhere.

The channel 15 is defined by a body in stainless steel, consisting of complementary elements made in a die and subsequently joined together by welding 21.

In transverse cross-section, the channel 15 has a U-shape, with a concave bottom 22 that has a substantially cylindrical surface. Lengthways, the channel has straight parts 23 which alternate with and are joined to curved parts 24, to give a configuration that is free of sharp bends and corners.

According to the preferred mode of construction, the spiral channel 15 has an inclination that varies according to length, with a gradient that increases towards the unloading passage or chute 20, to give the machine greater effectiveness in treating the articles that need drying, polishing and burnishing.

What is claimed is:

1. A machine for drying, polishing and burnishing cutlery and metal tableware, comprising a tank suspended over a base and moved by a vibrating device, and where said tank is provided with a treatment channel, designed to receive a drying and polishing material and the articles for treatment, said treatment channel rising in spiral shape from an entrance chute in a loading mouth up to an exit passage or chute for the articles, and has, in transverse cross-section, a U-shaped bottom, defined by a substantially concave cylindrical surface and, lengthways, by a series of straight parts that alternate with and are joined to curved parts, without sharp bends or corners.

2. The machine according to claim 1, in which the spiral treatment channel develops around the loading mouth and has an inclination at varies in length, with a steeper gradient towards the exit passage or chute.

3. The machine according to claim 1, in which at least the treatment channel includes stainless steel elements, which have been moulded then joined together by welding.

4. The machine according to claim 2, in which at least the treatment channel includes stainless steel elements, which have been moulded then joined together by welding.

5. An apparatus for drying and polishing wet articles with treatment material, the apparatus comprising:

a tank for receiving the wet articles, said tank including a treatment channel receivable of the wet articles and the treatment material, said treatment channel rising in a spiral shape from an entrance chute in a loading mouth up to an exit passage or for the articles, said treatment channel having a U-shaped cross section with defined by a substantially concave cylindrical surface, said treatment channel having a longitudinal path divided to a plurality of substantially straight sections which alternate with a plurality of curved sections.

* * * * *